United States Patent [19]

Hirschmanner et al.

[11] 4,442,690

[45] Apr. 17, 1984

[54] COILER-FURNACE COMBINATION

[75] Inventors: Franz Hirschmanner, Leonding; Ernst Rom, St. Veit a.d. Glan, both of Austria

[73] Assignee: Voest-Alpine Aktiengesellschaft, Linz, Austria

[21] Appl. No.: 401,370

[22] Filed: Jul. 23, 1982

[30] Foreign Application Priority Data

Aug. 24, 1981 [AT] Austria ..... 3669/81

[51] Int. Cl.[3] ..... B21C 47/06; B21C 47/18

[52] U.S. Cl. ..... 72/128; 72/148; 72/202

[58] Field of Search ..... 72/128, 146, 148, 200, 72/202, 342; 242/78, 78.1, 78.6, 78.7, 78.8

[56] References Cited

U.S. PATENT DOCUMENTS

| | | | |
|---|---|---|---|
| 2,628,790 | 2/1953 | Schmidt et al. | 72/148 X |
| 2,646,231 | 7/1953 | Frielinghaus | 72/148 |
| 2,658,741 | 11/1953 | Schmidt et al. | 72/200 X |
| 2,675,720 | 4/1954 | Ferm | 72/148 |
| 3,003,713 | 10/1961 | King | 242/78.1 |
| 3,240,043 | 3/1966 | Sieger | 72/148 |
| 3,328,990 | 7/1967 | Sieger et al. | 72/148 |
| 3,613,426 | 10/1971 | Adair et al. | 72/202 |
| 4,005,830 | 2/1977 | Smith | 72/146 X |

*Primary Examiner*—E. Michael Combs
*Attorney, Agent, or Firm*—Kurt Kelman

[57] ABSTRACT

A coiler-furnace combination comprises a horizontal coiler, a strip guide which comprises two pressure rollers for forcing the strip against the coil and two part-cylindrical guide segments, one of which precedes the other in the winding sense and adjoins a strip transfer bridge for transferring the strip to and from the coiler, and a strip lifter. To simplify the structure, the two guide segments are secured to arms which pivoted on pivots disposed outside the heat-shielding hood and parallel to the mandrel. The strip lifter is constituted by the delivery edge of that guide segment which succeeds the other in the coiling sense. The strip transfer bridge consists of a roller conveyor and at its end facing the mandrel has a pressure roller for forcing the strip against the coil.

5 Claims, 5 Drawing Figures

Figure 1:
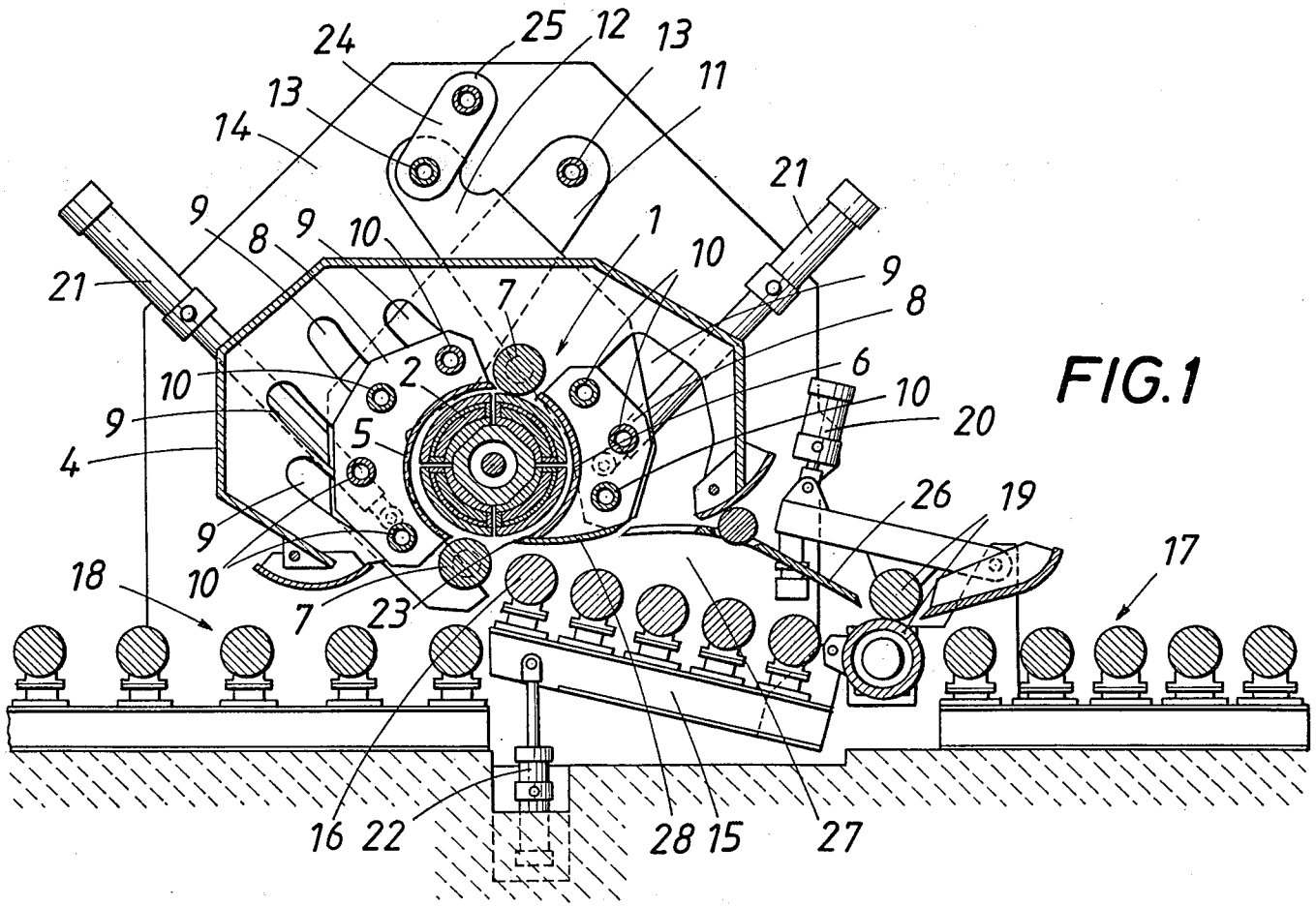

1
2
3
4
5
6
7
8
9
10
11
12
13
14
15
16
17
18
19
20
21
22
23
26
27
28

COILER-FURNACE COMBINATION

This invention relates to a coiler-furnace combination comprising a horizontal coiler having a mandrel which is disposed in a heat-shielding hood, strip-guiding means, which surround the mandrel of the coiler and comprise pressure rollers for forcing a strip to be coiled and uncoiled against the mandrel or coil and two part-cylindrical guide segments, which are adapted to be forced against the mandrel from opposite sides and one of which precedes the other in the coiling sense and adjoins a strip transfer bridge, which is pivoted below the mandrel and serves to transfer the strip to and from the pivotally movable strip lifter carried by one of said guide segments, and means for heating strip coiled on said mandrel.

In order to ensure the desired rolling temperature in reversing hot-rolling mills, the strip to be rolled must be reheated between successive passes. For this purpose, coiler-furnace combinations are provided before and behind the reversing rolling mill stands and the strip is coiled by the coiler of such combination after each pass and is heated usually with hot gases. It is known from German Patent Specification No. 811,837 that considerable cropping losses at both ends of the strip can be avoided if the entire strip is coiled on the mandrel of the coiler-furnace combination. If the entire strip is coiled, special strip lifters are required, which permit the strip to be uncoiled when the sense of rotation of the reel has been reversed. These strip lifters are moved to engage the coil in a position in which they are inclined opposite to the uncoiling sense so that the lifter can extend below the leading end of the strip and can lift said end from the coil. The leading end of the strip which has thus been lifted is then moved over a strip transfer bridge to a roller conveyor. The withdrawal of the strip from the coiler is assisted by driven pinch rollers. Owing to the different coil diameters, the strip lifter is not rigidly mounted but is pivoted to one of two guide segments, which surround the mandrel of the coiler and constitute a strip guide and are provided with pressure rollers in contact with the strip which is to be coiled and uncoiled. As the strip is coiled, the strip lifter mounted on one guide segment is adjusted in accordance with the increase of the diameter of the coil because the latter forces apart the guide segments which are adapted to be forced against opposite sides of the coil. As a result, the lifter can be moved to engage the coil regardless of its diameter when the strip has been coiled.

To ensure that the angular position of the strip transfer bridge for transferring the strip to and from the coiler can also be adjusted to the instantaneous diameter of the coil, that end of said bridge which is nearest to the mandrel is pivoted to the other end of the guide segment of the strip guide and is thus carried along by said guide segment. Said known coiler-furnace combination has the disadvantage that the members which are adjustable for the required adaptation to the different coil diameters are disposed within the heat-shielding hood so that the combination is highly liable to be deranged owing to the high temperature of the furnace. Besides, the elimination of troubles is difficult because said parts are disposed inside the heat-shielding hood.

For this reason it is an object of the invention to avoid these disadvantages and so to improve a coiler-furnace combination of the kind described first hereinbefore that an adaptation to different coil diameters is permitted and a simple structure which is reliable in operation is ensured.

This object is accomplished according to the invention in that the two guide segments are secured to pivoted arms, which extend transversely to the direction in which pressure is applied by the guide segments and said arms are mounted on pivots which are parallel to the mandrel and disposed outside the heat-shielding hood, the guide segment which succeeds the other in the coiling sense has a delivery edge, which constitutes the strip lifter, and the strip transfer bridge is provided with a separate swivelling drive and preferably consists of a roller conveyor which at its end nearest to the mandrel has a pressure roller for forcing the strip against the coil.

The two guide segments can be adjusted in a simple manner because they are secured to arms which are pivoted outside the heat-shielding hood on axes which are parallel to the mandrel. Because the pivots are disposed outside the heat-shielding hood, the bearings are not exposed to excessively high temperatures and the strip lifter can rigidly be connected to the guide segment which succeeds the other in the coiling sense because the pivotal movement of the guide segment will ensure that the strip lifter will be in the proper position when it engages the coil. For this reason the delivery edge of that guide segment which succeeds the other in the coiling sense may constitute a strip lifter so that there is no need for separate strip strippers and separate actuators therefor.

Because the guide segments are mounted on pivoted arms which are mounted on pivots disposed outside the heat-shielding hood, the extent through which that end of each guide segment which is more remote from the associated pivot can be adjusted will be increased so that it may not be desirable to pivot the strip transfer bridge to such end of a guide segment. For this reason the strip transfer bridge is provided with a separate swivelling drive, which eliminates the need for pivoting the bridge to a guide segment. If that strip transfer bridge consists of a roller conveyor, the use of a separate drive will afford the additional advantage that a pressure roller for applying pressure to the strip may be provided at that end of the strip transfer bridge which is nearest to the mandrel. The pivoting of the guide segments permits a larger space between said segments; said space can be bridged by the pressure roller of the strip transfer bridge in a manner which is particularly favorable for the guidance of the strip because the strip to be coiled or uncoiled will be forced against the coil close to the point where the strip runs up onto the coil.

If the pivots for the arms secured to the guide segments are disposed above the heat-shielding hood, both pivots will easily be accessible so that the supply of coolant and lubricant will be simplified. But the larger extent through which the delivery edge forming the strip lifter can be adjusted necessitates an additional pivotal movement of the associated guide segment for a movement of the strip lifter to its operative position. This can be accomplished in a simple manner in that the pivot of the arm connected to the guide segment which comprises the strip lifter is adjustable by means of a crank.

In a modified embodiment, the pivot of the arm secured to the guide segment which comprises the strip lifter is disposed below the heat-shielding hood. In that case there is no need for an additional pivotal movement of that arm because the delivery edge which constitutes the strip lifter will be in a favorable angular position regardless of the angular position of that arm.

Whereas the swivelling drives may be of various types because only the adjustment is essential for accomplishing the result aimed at by the invention, particularly simple conditions will be obtained if the pivoted arms secured to the guide segments, on the one hand, and the strip transfer bridge, on the other hand, are pivotally movable by means of positioning cylinders which act on the part to be adjusted at a point which is spaced from its pivotal axis.

Figure 2:
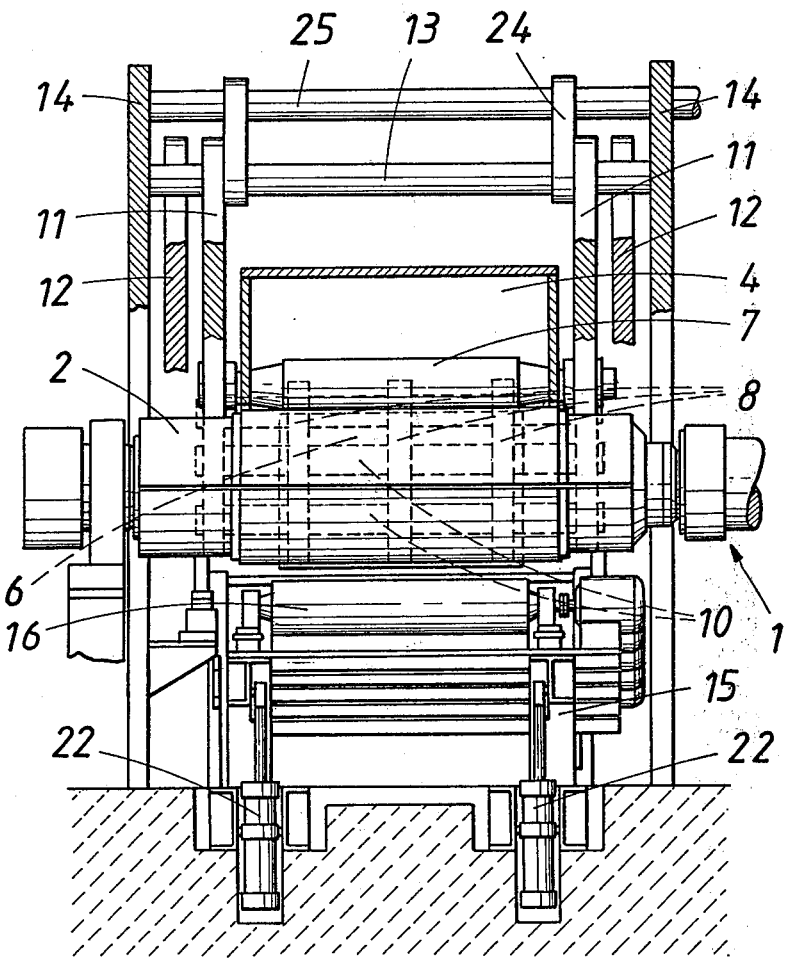
Figure 3:
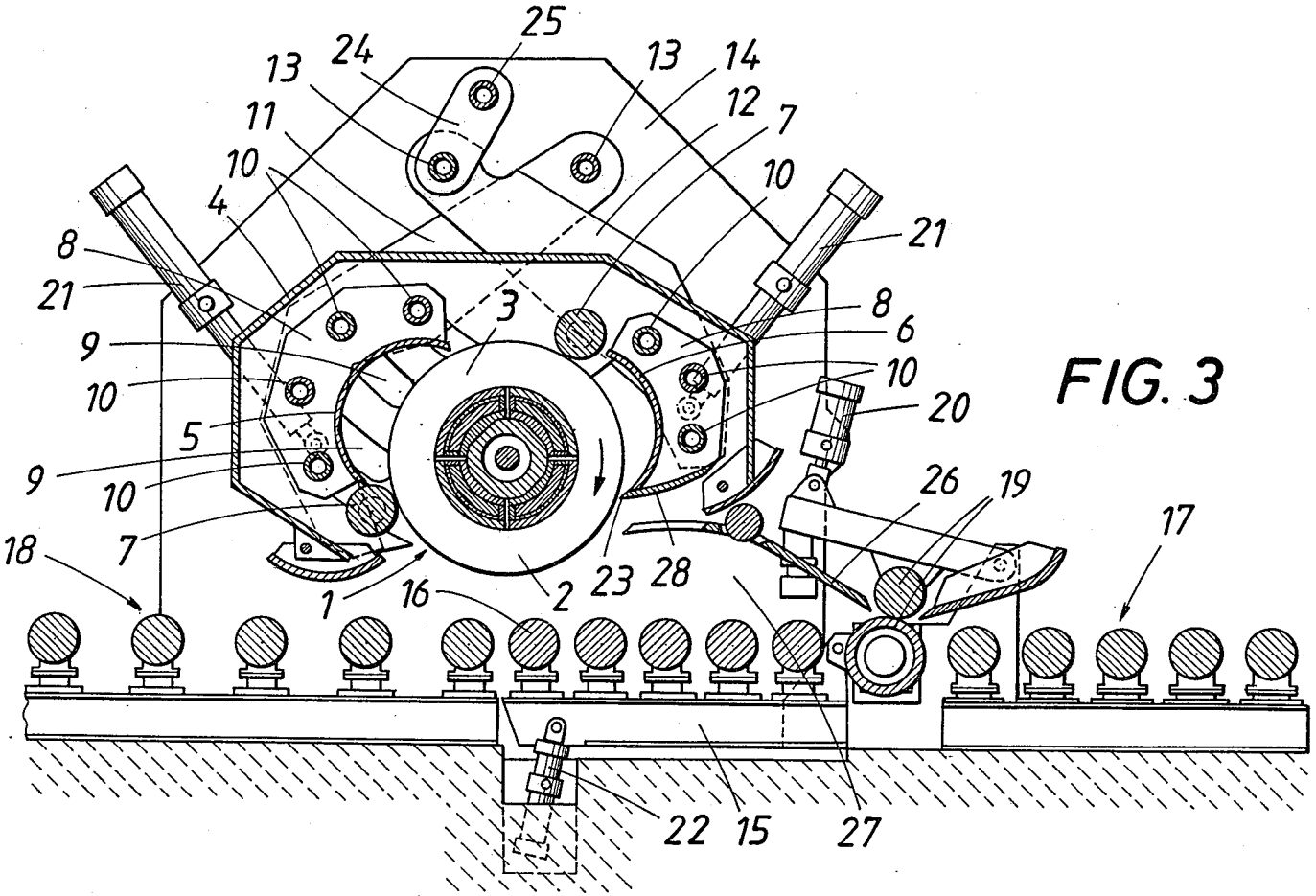
Figure 4:
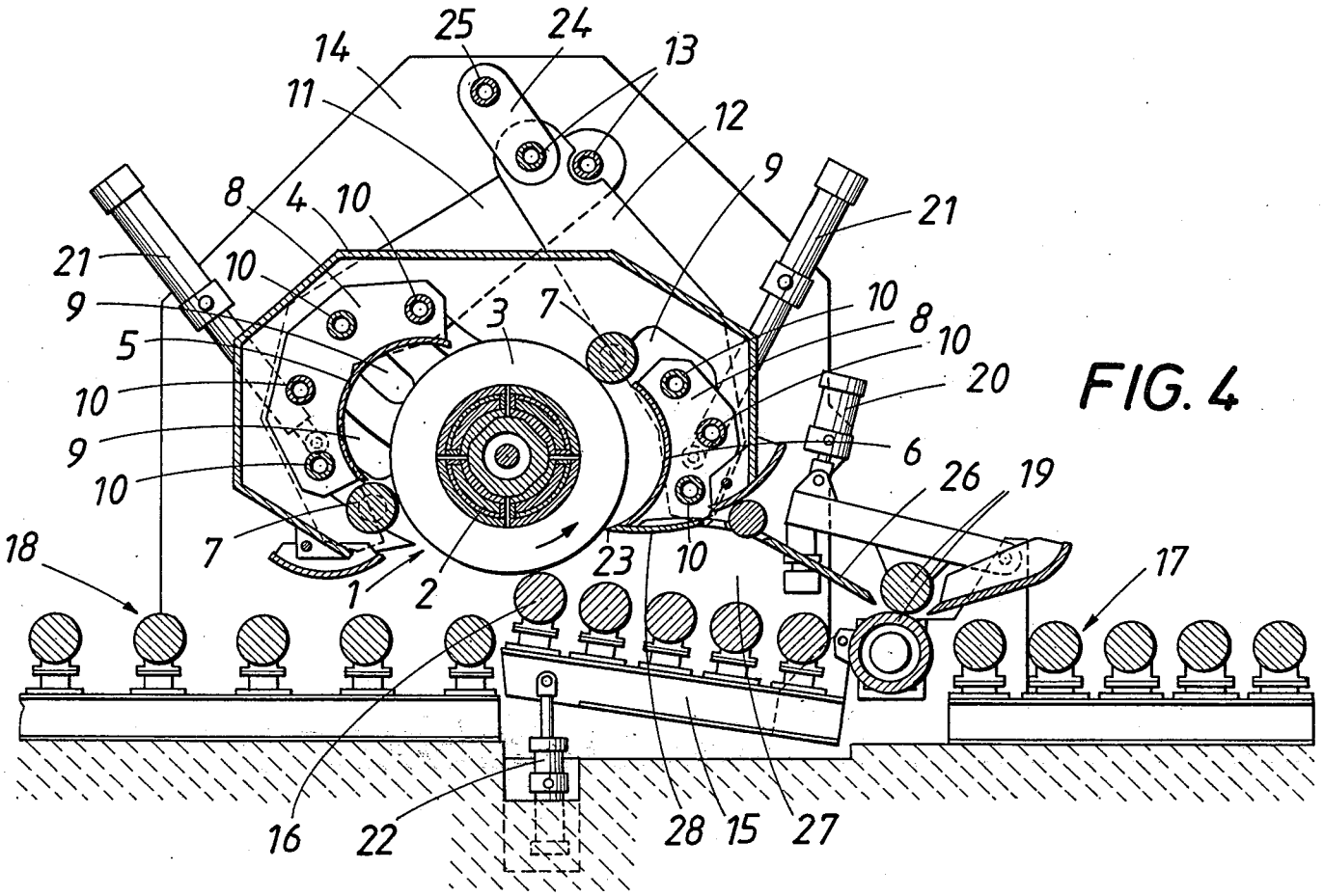
Figure 5:
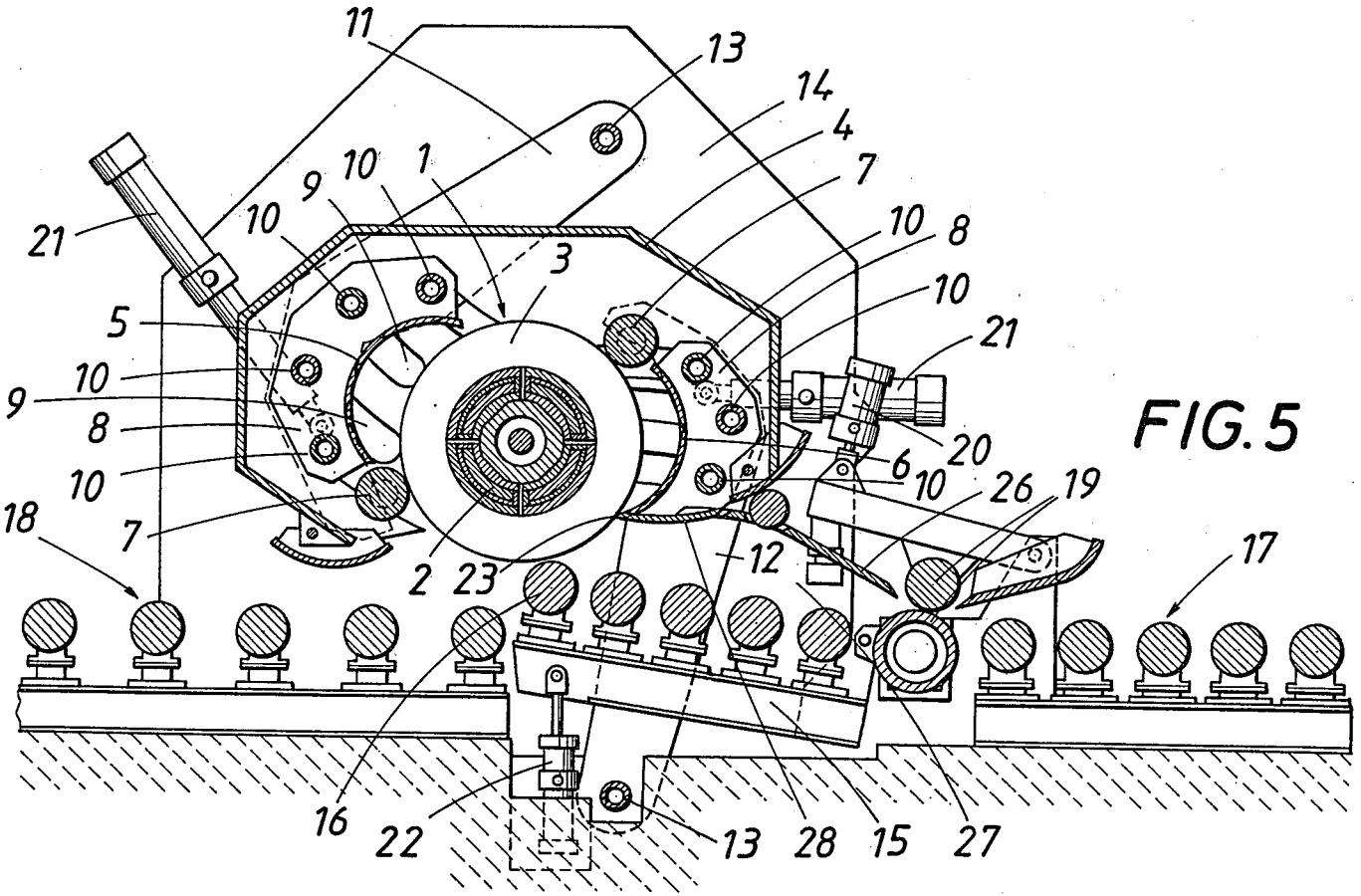

Illustrative embodiments of the invention are shown in the accompanying drawing, in which FIG. 1 is a simplified longitudinal sectional view showing a coiler-furnace combination embodying the invention, FIG. 2 is a transverse sectional view showing that coiler-furnace combination, FIG. 3 is a view which is similar to FIG. 1 and shows the coiler-furnace combination with a coiled strip, FIG. 4 shows the coiler-furnace combination in stripping position and FIG. 5 is a longitudinal sectional view showing a modified coiler-furnace combination embodying the invention.

The coiler-furnace combination shown in FIGS. 1 to 4 essentially comprises a coiler 1 having an expanding mandrel 2 which constitutes a heater for the coil 3 and is disposed within a heat-shielding hood 4. That mandrel 2 is surrounded by strip-guiding means, which consist of two part-cylindrical guide segments 5 and 6, which are provided with pressure rollers 7. The guide segments 5 and 6 are welded to web plates 8, which are connected to pivoted arms 11 and 12 by tubes 10, which extend through apertures 9 of the heat-shielding hood. The pivoted arms 11 and 12 are disposed outside the heat-shielding hood 4 and have pivots 13, which extend parallel to the axis of the mandrel and are mounted in side walls 14 of a frame.

A pivoted strip transfer bridge 15 consisting of a roller conveyor is disposed below the mandrel 2 and when swung up to its operative position adjoins that guide segment which precedes the other in the coiling sense indicated in FIGS. 1 to 3. The roller 16 at that end of the bridge 15 which is nearest to the mandrel 2 constitutes a pressure roller for forcing the strip against the coil.

The strip to be coiled is moved to a pair of pinch rollers 19 on a roller conveyor 17, which can be connected by the strip transfer bridge 15 to a succeeding roller conveyor 18. A cylinder 20 serves to force the upper roller 20 of the pair 19 against the lower roller thereof. From the pair of pinch rollers 19, the leading end of the strip is moved on the rollers of the strip transfer bridge 15 into the guiding gap between the mandrel 2 and the guide segments 5 and 6 and in said gap is guided around the mandrel, which has a peripheral velocity that is equal to the velocity of the entering strip so that the mandrel can smoothly take over the strip in that the segments of the mandrel are expanded. As the coil increases in diameter, the guide segments 5 and 6 carrying the pressure rollers 7 are forced apart against the pressure applied to pneumatic positioning cylinders 21, which act on the arms 11 and 12 at points spaced apart from the pivots 13. Similarly, the end roller 16 of the strip transfer bridge 15 is forced away from the coil 3 against the pressure applied to the positioning cylinders 22, which serve to swivel the strip transfer bridge so that constant, good conditions for guiding the strip to be coiled are always provided.

If the strip has been coiled on the mandrel 2 and has been heated by the mandrel and the strip is then to be uncoiled, the outer end of the strip must be lifted from the coil 3 by means of a strip lifter. To eliminate the need for separate strip lifters, the strip lifter is constituted by the delivery edge 23 of that guide segment 6 which succeeds the other in the coiling sense. In an arrangement in which the pivots 13 of the pivoted arms 11 and 12 are disposed above the heat-shielding hood 4, an additional pivotal movement is to be imparted to the pivoted arm 12 for the guide segment 6 so that the strip lifter constituted by the delivery edge 23 can be engaged with the coil. In the embodiment shown in FIGS. 1 to 4, this is accomplished by a crank 24, which carries the pivot 13 of the pivoted arm 12 and can be adjusted by the crankshaft 25 between the end positions shown in FIGS. 3 and 4. By this additional pivotal movement of the pivoted arm 12, the delivery edge 23 is engaged with the coil so that upon a reversal of the rotation of the mandrel 2 the leading edge of the strip will be engaged by the delivery edge 23 of the guide segment 6 and will be guided into the guide passage 27, which is defined between the strip transfer bridge 15 and a guide wall 26 and leads to the pinch rollers 19. That guide passage 27 is closed by a guide wall 28, which is formed by the guide segments 6 and leads away from the delivery edge and which is shifted into the space between the guide wall 26 and the coil 3 as a result of the pivotal movement by which the lifter formed by the delivery edge 23 is moved into engagement with the coil. To permit that shifting movement, the guide walls 26 and 28 have staggered recessed like combs in the area in which they overlap. The overlap is necessary to ensure the presence of a closed guide passage also during the threading operation when the guide segment 6 has been swung close to the mandrel 2, as is shown in FIG. 1.

The possibility of imparting an additional pivotal movement to the arm 12 by means of the crank 24 does not only permit an engagement of the strip lifter constituted by the delivery edge 23 into engagement with the coil but also permits a proper adjustment of the threading gap between the mandrel 2 and the guide segment 6. It is believed that this need not be explained more in detail.

As is apparent from FIG. 5, the arm 12 which carries the guide segment 6 may alternatively be mounted on a pivot 13 disposed below the heat-shielding hood 4. Such an arrangement affords the advantage that there is no need for an additional pivotal movement of the guide segment 6 for engaging the delivery edge 23 with the coil 3 because in such case the delivery edge 23 is closer to the pivot 13 so that it is pivotally movable through a smaller extent and the delivery edge 23 will be in a lifting position regardless of the angular position of the guide segment.

What is claimed is:

1. In a coiler-furnace combination comprising a heat-shielding hood, a horizontal coiler mandrel disposed in said hood and rotatable in a predetermined sense to coil strip on said mandrel and in the opposite sense to uncoil said strip from said mandrel, strip-guiding means for guiding said strip around said mandrel as it is coiled on and uncoiled from said mandrel, which strip-guiding means comprise pressure rollers for forcing said strip against said mandrel and two part-cylindrical guide segments which are disposed on opposite sides of and movable toward and away from said mandrel, one of said guide segments preceding the other in said predetermined direction, said other guide segment having a delivery edge for delivering said strip as it is coiled up on said mandrel, actuating means for urging each of said guide segments toward said mandrel generally in a predetermined direction, means for heating strip coiled on said mandrel, a strip transfer bridge, which is pivoted below said mandrel and adapted to transfer said strip from and to said mandrel and is adjoined by said one guide segment, and a pivoted strip lifter which is disposed above said bridge and adapted to lift the outer end of strip coiled on said mandrel from the remainder of said coiled strip, the improvement residing in that each of said guide segments is secured to a pivoted arm, which extends transversely to said predetermined direction and is mounted outside said hood on a pivot having an axis that is parallel to the axis of said mandrel, said delivery edge constitutes said strip lifter, and separate drive means are provided for imparting a pivotal movement to said bridge independently of said actuating means.

2. The improvement set forth in claim 1, wherein said bridge comprises a roller conveyor comprising a roller which is nearest to said mandrel, and said bridge is pivotally movable by said drive means to a position in which said end roller engages strip coiled on said mandrel.

3. The improvement set forth in claim 1, wherein said pivots are disposed above said hood and a crank is provided, which is operable to displace the pivot for that of said arms which is connected to said other guide segment.

4. The improvement set forth in claim 1, wherein said pivot for said pivoted arm secured to said other guide segment is disposed below said hood.

5. The improvement set forth in claim 1, wherein said actuating means and said drive means consist of fluid-operable cylinders.

* * * * *